US005886293A

United States Patent [19]

Nauflett et al.

[11] Patent Number: 5,886,293

[45] Date of Patent: Mar. 23, 1999

[54] PREPARATION OF MAGNESIUM-FLUOROPOLYMER PYROTECHNIC MATERIAL

[75] Inventors: George W. Nauflett, Ft. Washington; Robert E. Farncomb, Accokeek, both of Md.; Lalit Chordia, Pittsburgh, Pa.

[73] Assignee: The United States of America as represented by the Secretary of the Navy, Washington, D.C.

[21] Appl. No.: 30,008

[22] Filed: Feb. 25, 1998

[51] Int. Cl.[6] ..... C06B 21/00; C06B 27/00

[52] U.S. Cl. ..... 149/109.6; 149/19.2; 149/19.9; 149/87; 264/3.5; 264/3.6

[58] Field of Search ..... 264/3.5, 3.6; 149/109.6, 149/87, 19.2, 19.91

[56] References Cited

U.S. PATENT DOCUMENTS

| | | | |
|---|---|---|---|
| 3,152,935 | 10/1964 | Cadwallader et al. | 149/87 |
| 3,753,811 | 8/1973 | Julian et al. | 149/87 X |
| 3,765,334 | 10/1973 | Rentz et al. | 102/27 R |
| 4,447,278 | 5/1984 | Sedat | 149/19.91 |
| 4,722,280 | 2/1988 | Sanai | 149/109.6 X |
| 5,443,796 | 8/1995 | Coeling et al. | 422/129 |
| 5,472,529 | 12/1995 | Arita et al. | 149/2 |
| 5,548,004 | 8/1996 | Mandel et al. | 523/342 |
| 5,574,248 | 11/1996 | Brown et al. | 149/11.3 |
| 5,679,921 | 10/1997 | Hahn et al. | 149/87 X |

*Primary Examiner*—Peter A. Nelson
*Attorney, Agent, or Firm*—John Forrest; Roger D. Johnson

[57] ABSTRACT

A process for preparing energetic materials by (1) dissolving a vinylidenefluoride-hexafluoropropylene copolymer in a ketone that is acetone, methyl ethyl ketone, or mixtures thereof, (2) adding polytetrafluoroethylene particles and reactive metal (magnesium, aluminum, or their alloys) particles to form a slurry, (3) adding $CO_2$ to the slurry to precipitate out the copolymer which then coats the polytetrafluoroethylene and reactive metal particles, and (4) separating the copolymer-coated particles from the ketone and $CO_2$.

21 Claims, 2 Drawing Sheets

PREPARATION OF MAGNESIUM-FLUOROPOLYMER PYROTECHNIC MATERIAL

BACKGROUND

This invention relates to energetic materials and more particularly to methods of producing energetic materials from metals and fluoropolymers.

Pyrotechnics are mixtures of substances that produce noise, light, heat, smoke, or motion when ignited. They are used in matches, incendiaries, and other igniters; in fireworks and flares; in fuses and other initiators for primary explosives; in delay trains; and for powering mechanical devices. Military pyrotechnics include a wide range of devices for illumination, signaling, incineration, and gas generation. Military pyrotechnic devices are characterized by more rugged construction and greater resistance to adverse environmental conditions with concomitant higher cost, reliability, and safety than are civilian pyrotechnics.

Magnesium/Teflon/Viton (MTV) pyrotechnics are used by the Armed Forces to manufacture rocket motor igniters and flare decoys. MTV is currently manufactured using the shock-gel process in which: (1) the Viton binder is dissolved in acetone; (2) the magnesium and Teflon particles are added to the Viton/acetone solution to form a slurry; (3) and hexane is added to the slurry to shock the slurry and precipitate the Viton out of solution onto the surfaces of the magnesium and Teflon particles. The solvent is then decanted from the mixture and the procedure is repeated to ensure that all the remaining acetone is washed from the pyrotechnic material. Although the process is extremely effective in coating the magnesium and Teflon, it is a lengthy batch process which requires an extremely large quantity of solvent (acetone and hexane) to coat the magnesium and Teflon with the Viton binder. It takes five 55-gallon drums of solvent to process 200 pounds of MTV. The collected acetone and hexane mixture must be disposed of as hazardous waste due to the toxic nature of the solvent.

It would be desirable to provide an method of producing high quality energetic materials composed of a mixture of magnesium (or magnesium alloys, aluminum, aluminum alloys, etc.) particles and polytetrafluoroethylene (e.g., Teflon) particles in a vinylidene fluoride-hexafluoropropylene copolymer (e.g., Viton A, Fluorel) binder without generating large volumes, of hazardous waste.

SUMMARY

Accordingly, an object of this invention is to provide a new process for producing magnesium/fluoropolymer energetic materials.

Another object of this invention is to provide a process for producing magnesium/fluoropolymer energetic materials without producing large volumes of hazardous waste.

These and other objects of this invention are accomplished by providing a process comprising:

(1) dissolving a vinylidene fluoride-hexafluoropropylene copolymer in a ketone solvent that is acetone, methyl ethyl ketone, or mixtures thereof;

(2) forming a paste by adding a mixture of polyetetrafluoroethylene particles and reactive metal particles that are magnesium particles, magnesium alloy particles, aluminum particles, aluminum alloy particles, or mixtures thereof to the solution form in step (1);

(3) adding liquid $CO_2$ to the paste formed in step (2) to cause the vinylidenefluoride-hexafluoropropylene copolymer to precipitate out of the ketone solvent and coat the polytetrafluoroethylene particles and the reactive metal particles while the paste is agitated; and (4) separating the vinylidenefluoride-hexafluoropropylene copolymer-coated polytetrafluoroethylene particles and reactive metal particles from the ketone solvent and the $CO_2$.

The ketone solvent and the $CO_2$ are preferably separated from each other and reused.

BRIEF DESCRIPTION OF THE DRAWINGS

A more complete understanding of the invention and many of its attendant advantages thereof will be readily appreciated as the same becomes better understood by reference to the following detailed description when considered in connection with the accompanying drawings, wherein.

DESCRIPTION

The process of the present invention produces energetic materials by coating a mixture of polytetrafluoroethylene (Teflon) particles and reactive metal particles with a copolymer hexafluoropropylene and vinylidenefluoride. The reactive metal particles are preferably magnesium particles, magnesium alloy particles, aluminum particles, aluminum alloy particles, or mixtures of these particles, with the magnesium particles being the most preferred. The vinylidenefluoride-hexafluoropropylene copolymers which may be used in this process are soluble in acetone or methyl ethyl ketone and insoluble in carbon dioxide ($CO_2$). The vinylidenefluoride-hexafluoropropylene (70:30) copolymer is most preferred. This copolymer is available under the tradenames VITON and FLUOREL. In the preferred embodiment, this process is used to produce MTV (magnesium-Teflon-Viton), a pyrotechnic material used to manufacture rocket motor igniters and flare decoys.

The weight percentages of the staring materials: reactive metal particles, polytetraethylene particles, and vinlidenefluoride-hexafluoropropylene copolymer are determined by the desired composition of the energetic material product and the use it will be put to. The process of the present invention is a physical coating process which will be operable over a wide range of relative weight percentages of these ingredients.

The process of the present invention coats reactive metal particles and polytetrafluoroethylene (Teflon) particles with a vinylidenefluoride-hexafluoropropylene copolymer to produce an energetic material. A well agitated paste slurry of reactive metal particles and polytetrafluoroethylene particles in a solution of the vinylidene fluoride-hexafluoropropylene copolymer in acetone or methyl ethyl ketone is formed and liquid $CO_2$ is added to the acetone or methyl ethyl ketone until all the copolymer is precipitated out as a coating on the reactive metal particles and the polytetrafluoroethylene particles. The $CO_2$ and the ketone (acetone or methyl-ethyl ketone) are removed from the product copolymer-coated magnesium and polytetrafluoroethylene particles and the free-flowing product is collected. The acetone or methyl ethyl ketone and $CO_2$ are separated and recycled to prepare the next batch. Product which does not meet specifications is also recycled. This the process converts the raw materials into the product without producing significant amounts of waste materials.

Figure 1:
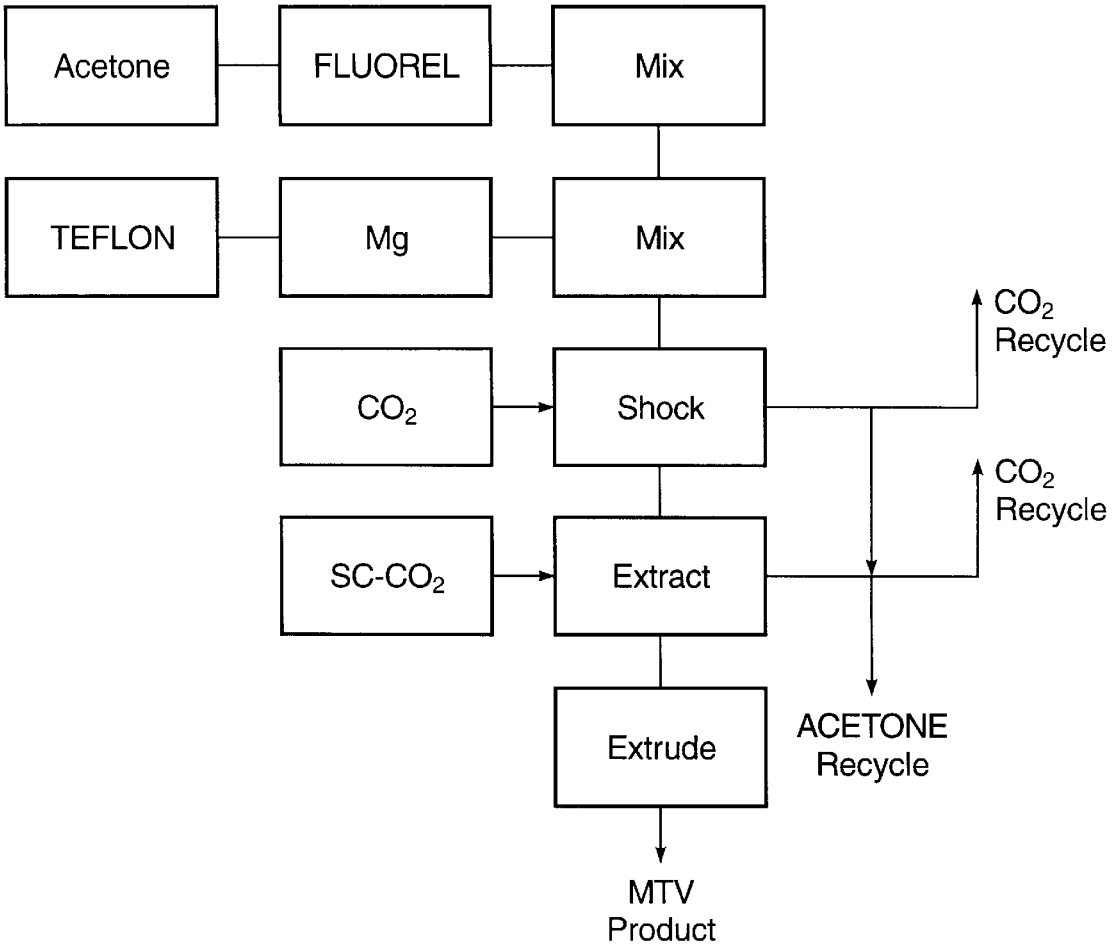
FIG. 1 is a flow diagram illustrating the process of this invention.

FIG. 1 is a flow diagram of the present process being used to prepare a MTV (magnesium-Teflon-Viton) pyrotechnic composite. First acetone and the vinylidene fluoride-hexafluoropropylene(70:30) copolymer (Viton or Fluorel) are mixed together to produce a solution of the copolymer in acetone. The solution will preferably comprise from about 9 to about 25 and more preferably from 16 to 19 weight percent of the vinylidenefluoride-hexafluoropropylene copolymer with the remainder of the solution being acetone.

As shown in FIG. 1, the next step is to mix magnesium particles and polytetrafluoroethylene particles with the vinylidene fluoride-hexafluoropropylene(70:30) copolymer /acetone solution to produce a slurry. The slurry is a paste having a consistency similar to poured concrete. The amounts of magnesium, polytetrafluoroethylene, and vinylidene fluoride-hexafluoropropylene(70:30) copolymer added are the amounts required to produce the desired energetic composite. For instance, in the examples, 54 weight percent of magnesium particles, 30 weight percent of polytetrafluoroethylene (Teflon), and 16 weight percent of vinylidenefluoride-hexafluoropropylene(70:30) copolymer (Viton or Fluorel) were used to prepare a MTV pyrotechnic material.

Referring again to the flow chart of FIG. 1, the next step is the shock or super-shock step in which the vinylidene fluoride-hexafluoropropylene(70:30) copolymer is shocked or driven from the acetone to precipitate as a coating on the polytetrafluoroethylene particles and the magnesium particles. It is critical that the slurry is vigorously agitated (e.g., stirred) during this shock step in order to produce a high quality product. This shock precipitation step is run in a pressure vessel in which the outlet valve is closed and only the supercritical $CO_2$ inlet is open. In the presence of acetone, the critical temperature of $CO_2$ is raised from 30.1° C. to about 120° C. As a result, the supercritical $CO_2$ is converted to liquid $CO_2$ in the pressure vessel. Because $CO_2$ and acetone are infinitely soluble in each other, the $CO_2$ readily dissolves in the acetone to produce a $CO_2$/acetone solution. The vinylidene fluoride-hexafluoropropylene (70:30) copolymer is soluble in acetone but insoluble in $CO_2$. As a result, the $CO_2$ shocks or drives the copolymer out of the acetone as a precipitate that coats the polytetrafluoroethylene particles and the magnesium particles. Because the acetone is recycled in the preferred embodiment of this invention, it is critical that enough $CO_2$ is added to drive all of the vinylidene fluoride-hexafluoropropylene(70:30) copolymer from the acetone. Even a small amount of the copolymer will accumulate in the system and clog valves and sensors, making the system dangerous to operate. At 40 weight percent acetone (60 weight percent $CO_2$) the recovered acetone contained no vinylidene fluoride-hexafluoropropylene(70:30) copolymer (Fluorel). However, at 80 weight percent acetone (20 weight percent $CO_2$) the recovered acetone contained 36.4 weight percent Fluorel and at 54 weight percent acetone (46 weight percent $CO_2$) the recovered acetone contained 3 weight percent Fluorel. Therefore, $CO_2$ is preferably added until the acetone/$CO_2$ solution contains at least 60 weight percent of $CO_2$ and no more than 40 weight percent acetone.

After all the vinylidene fluoride-hexafluoropropylene (70:30) copolymer has been precipitated from the acetone, the acetone is removed in an extraction step (see FIG. 1). This is done by opening the outlet valve in the pressure vessel and continuing the input of the supercritical $CO_2$ while the slurry is vigorously agitated (e.g., stirred). After the acetone/CO2 solution has been flushed out of the reactor, the critical temperature of the $CO_2$ drops back down to about 30.1° C. and the supercritical $CO_2$ is no longer liquefied. The input of supercritical $CO_2$ is continued while solid MTV product is vigorously agitated until all the acetone adhering to the MTV particles is removed. After no more acetone is detected in the supercritical $CO_2$ exhaust leaving the pressure vessel, the supercritical $CO_2$ input is stopped and the solid MTV product is collected. The free-flowing solid MTV crumb product may then be extruded using conventional means.

In the preferred embodiment as indicated in FIG. 1, the $CO_2$ and acetone flushed from the pressure vessel are separated and then recycled. In the examples, a Cyclone separator is used to separate the acetone as a liquid and the $CO_2$ as a gas.

In the general process of this invention the carbon dioxide ($CO_2$) which is fed into the pressure vessel in the shock step and the extraction step (acetone or methyl ethyl ketone removal) is preferably at a pressure of from about 1,000 to about 10,000, more preferably from 1,000 to 5,000, and still more preferably from 2,000 to 4,500 psi, and at a temperature or preferably from about 15 to about 80, more preferably from 31 to about 80, and still more preferably from 60 to 80° C. The $CO_2$ will be either in the form of a liquid or a supercritical fluid. If the $CO_2$ is both at a temperature above its critical temperature (30.1° C.) and at a pressure about its critical pressure (1044 psi?), the $CO_2$ feed will be a supercritical fluid. However, in the presence of either acetone or methyl ethyl ketone the critical temperature of $CO_2$ is raised well above 80° C. and the supercritical $CO_2$ fluid is converted into liquid $CO_2$.

The $CO_2$ readily dissolves in the acetone or methyl ethyl ketone. The vinylidenefluoride-polyhexafluoropropylene copolymers are soluble in acetone or methyl ethyl ketone but insoluble in $CO_2$. Thus, the $CO_2$ shocks or drives the copolymer from the ketone solution and the precipitating copolymer forms a coating on the polytetrafluoroethylene particles and the reactive metal particles. Because the acetone or methyl ethyl ketone is recycled, it is critical that all vinylidenefluoride-hexafluoropropoylene copolymer is removed (precipitated) from the ketone/$CO_2$ solution. As a result $CO_2$ should be added until the ketone (acetone, methyl ethyl ketone, or mixtures thereof)/$CO_2$ solution preferably contains at least 60, more preferably at least 70, still more preferably at least 80, and most preferably at least 90 weight percent of $CO_2$. The composition of the ketone/$CO_2$ solution is easily calculated from the weight of ketone (acetone, methyl ethyl ketone, or mixtures thereof) used and the pressure, temperature, flow rate, and time of flow of the $CO_2$ feed stream.

Figure 2:
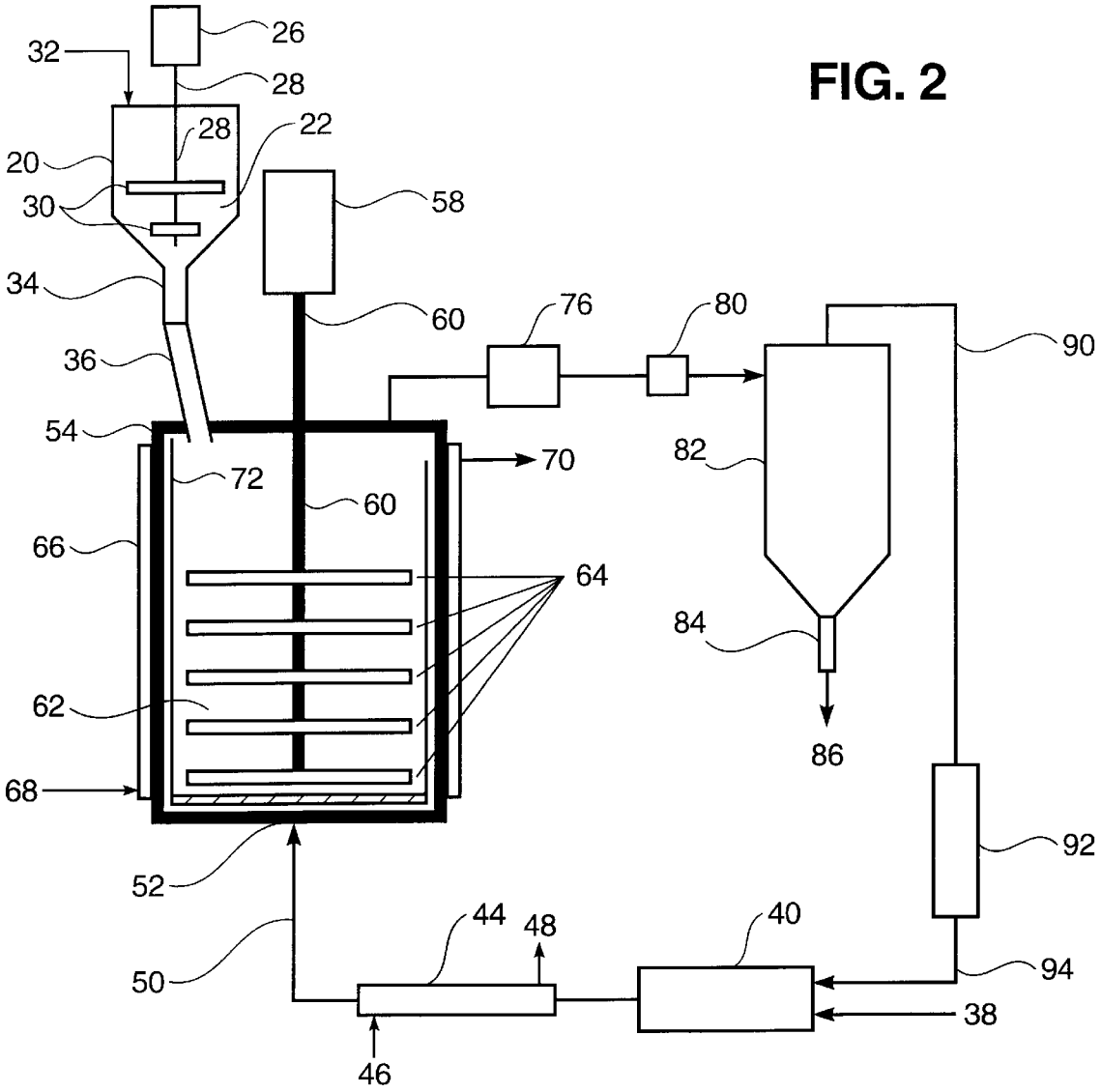
FIG. 2 is a general schematic drawing of equipment which may be used in the process of this invention.

FIG. 2 shows a schematic drawing of a typical apparatus set up which may be used in the present process where the $CO_2$ and the acetone are recycled. Shown is a premix vessel 20 in which a MTV premix 22 of magnesium particles and polytetrafluoroethylene (Teflon) particles in a solution of vinylidene fluoride-hexafluoropropylene(70:30) copolymer in acetone is prepared. The MTV premix 22 is mixed by premix agitator blades 30 which are attached to premix agitator shaft 28 which is driven by premix agitator motor 26. After the MTV premix 22 is prepared, the premix valve 34 is opened and the MTV premix 22 is transfer through tube 36 into pressure vessel 54 where the premix is now referred to as MTV material 62. The MTV material 62 starts off as the MTV premix; is converted by the $CO_2$ shock process step to raw, acetone-containing MTV product; and is finally converted to the dry, acetone-free, free-flowing MTV crumb final product. The MTV material 62 in pressure vessel 54 is agitated by agitator blades 64 which are attached to the pressure vessel agitator shaft 60 which is driven by the pressure vessel agitator motor 58. $CO_2$ is fed from line 38 into a compressor 40 where the $CO_2$ is compressed to a pressure of from 1,000 to 5,000 psi and then flows through a hot water heat exchanger 44 which heats the $CO_2$ above the supercritical temperature. (Hot water flows in through inlet 46, through the heat exchanger 44, and then out through the outlet 48.) The now supercritical $CO_2$ 50 flows through inlet valve 52 into the reaction vessel 54. Note that premix valve 34 and pressure reduction valve 76 are closed thus sealing the pressure vessel 54. The temperature of the pressure vessel 54 is kept at the temperature of the incoming supercritical $CO_2$ by a hot water jacket 66 which surrounds the pressure vessel 54. Hot water flows in through inlet 68, through the jacket 66, and out through the outlet 70. In the presence of acetone, the critical temperature of $CO_2$ is greatly raised, causing the supercritical $CO_2$ to liquefy and be dissolved in the acetone in the MTV material 62. After sufficient $CO_2$ has be added to shock or precipitate all the vinylidene fluoride-hexafluoropropylene copolymer from the acetone, the pressure reduction valve 76 is opened. Acetone and $CO_2$ are exhausted through the exhaust line 72 as the agitator blades 64 continue to mix the MTV material 62 and supercritical $CO_2$ 50 continues to flow in through the inlet valve 52. After the bulk of the liquid acetone has been removed from the MTV material 62, the critical temperature of $CO_2$ is reduced and the supercritical $CO_2$ is no longer liquefied. The agitation of the now dry MTV material 62 is continued and the flow of supercritical $CO_2$ is continued until acetone is no longer detected in the exhaust supercritical $CO_2$. The acetone and $CO_2$ is removed from the pressure vessel 54 through the exhaust line 72 which feeds the pressure reduction valve 76. From the pressure reduction valve 76 the $CO_2$ flows (at reduced pressure) through total hydrocarbon detector 80 (which monitors the $CO_2$ for acetone) and on to a Cyclone separator 82.. The Cyclone separator 82 separates the acetone as a liquid and the $CO_2$ as a gas. The liquid acetone is drained from the separator 82 though a cyclone separator valve 84 into the recovered acetone line 86. The acetone is recycled for use in a future batch. The $CO_2$ is passes through line 90 to a $CO_2$ purifier 92. A line 94 feeds the purified $CO_2$ to the compressor 40 for reuse in the processes. Addition $CO_2$ may be added through line 38 as needed. Finally, after all the acetone has been removed from the dry MTV material product 62, the agitator (58,60,64) is turned off and the flow of supercritical $CO_2$ through inlet valve 52 is stopped. The dry MTV material product 62 is then collected.

The general nature of the invention having been set forth, the following examples are presented as specific illustrations thereof. It will be understood that the invention is not limited to these specific examples but is susceptible to various modifications that will be recognized by one of ordinary skill in the art.

Experimental Super-Shock Process MTV Process

MTV paste was prepared in two steps. First the acetone solution of fluorel-2175 or Viton-A was prepared by standing overnight in a stainless steel beaker. Secondly, the magnesium (Type II) and Teflon 7C were slurried into the solution. The paste was added to a 500-mL pressure vessel equipped with a thermocouple, agitator and tachometer. An upward flow of carbon dioxide at 60° C. at 136 atm (2,000 psi) quenched the mixture under agitation (400±50 RPM). The MTV crumb was continuously extracted with a flow of supercritical $CO_2$ until acetone stopped collecting in traps. Dry free flowing gray MTV was poured out of the vessel and about 10 to 15% of MTV stuck to the agitator and vessel.

Shown in Table 1 is a summary of the MTV batches prepared. The Viton-A was replaced with Fluorel-2175 which has the same CAS number and is used as a direct replacement in MTV production.

Efficient agitation was found to be essential for the preparation of free flowing crumb similar to that produced by the Shock-Gel process. MTV Batches using one impeller produced free flowing crumb in 50 gram batches but not at the 100 gram level. The need for efficient agitation was demonstrated when four impeller blades were used. All the 100 to 200 grams batches of MTV crumb produced using four impeller blades were free flowing.

A parameter study was performed to determine the effects of acetone content on MTV the Super-Shock process. The amount of carbon dioxide needed to extract the acetone from the MTV was also investigated. The concentration of acetone at the start of each batch was calculated. At 40% acetone (60% $CO_2$) the recovered acetone contained no Fluorel. At 80% acetone (20% $CO_2$) the recovered acetone contained 36.4% Fluorel.

TABLE 1

SCF-MTV BATCHES
Acetone extraction 2,000 psi and 60° C.

| Example | Batch size (g) | Acetone in paste wt % | Acetone in $CO_2$ at start wt % | $CO_2$ flow | $CO_2$ used (g) | Acetone collected wt % | $CO_2$ flow (L/min) | Yield % | Fluorel in MTV wt % | Fluorel in acetone wt % | Footnote |
|---|---|---|---|---|---|---|---|---|---|---|---|
| 1 | 5 | 56 | 16 | Down | — | 65 | — | — | — | — | 1 |
| 2 | 5 | 61 | 26 | Up | — | 45 | — | — | — | — | 2 |
| 3 | 5 | 61 | 26 | Up | — | 46 | — | 46 | — | — | — |
| 4 | 10 | 58 | 56 | Up | — | 47 | — | — | — | — | 3 |
| 5 | 5 | 61 | 26 | Up | — | 61 | — | — | — | — | — |
| 6 | 50 | 40 | 13 | Up | 962 | 33 | — | — | — | — | 4 |
| 7 | 75 | 39 | 21 | Up | 1216 | 47 | 7 | — | — | — | 5 |
| 8 | 50 | 44 | 17 | Up | 1825 | 40 | 10 | 84 | 16 | 0 | 6 |
| 9 | 50 | 32 | 10 | Up | 897 | 25 | 20 | 86 | 17 | 0 | 7 |
| 10 | 50 | 41 | 12 | Up | 1322 | 68 | 5 | — | — | — | 8 |
| 11 | 100 | 50 | 41 | Up | 800+ | — | 10 | — | — | — | 9 |
| 12 | 150 | 54 | 68 | Up | 3015 | 45 | 15 | — | — | — | — |
| 13 | 200 | — | 0 | Up | 3053 | 51 | 15 | 96 | — | — | 10 |
| 14 | 200 | 41 | 60 | Up | 3830 | 23 | 30 | 96 | 12 | >0.1 | 11 |
| 15 | 200 | 51.6 | 83 | Up | 2583 | 22 | 15 | 95 | 11.9 | 36.4 | 12 |

TABLE 1-continued

SCF-MTV BATCHES
Acetone extraction 2,000 psi and 60° C.

| Example | Batch size (g) | Acetone in paste wt % | Acetone in $CO_2$ at start wt % | $CO_2$ flow | $CO_2$ used (g) | Acetone collected wt % | $CO_2$ flow (L/min) | Yield % | Fluorel in MTV wt % | Fluorel in acetone wt % | Footnote |
|---|---|---|---|---|---|---|---|---|---|---|---|
| 16 | 100 | 52 | 45 | Up | 1852 | 42 | 15 | 94 | 11 | 2 | 13 |
| 17 | 100 | 40 | 21 | Up | 1794 | 53 | 14 | 83 | 14 to 16 | >0.1 | 14 |
| 18 | 175 | 40 | 41 | Up | 1367 | 41 | 15 | 92 | 16 | >0.1 | 15 |

[1]Jerguson Gauge inert run (Mg replaced with Alumina) - downward flow $CO_2$ - 3% of Viton collected in trap.
[2]MTV not free flowing - need agitation - Teflon needs to be delumped
[3]10% extra Viton used - Upward flow $CO_2$ as Viton/acetone added from top 15 cm/min not fluidized - difficult to remove batch from Jerguson Gauge
[4]500-mL pressure vessel, Newport compressor, air controlled back pressure regulator - (Mg replaced with Alumina) - No Viton in collected acetone - inline filter became plugged. Last 300 psi of pressure released from bottom.
[5]inert run (Mg replaced with Alumina) - Exit filter became loose. (in future batches connected with fittings).
[6]Fluorel (lot FC2175), maganesium Type II (lot 92-M-066B), Teflon 7c (lot 970209) extra acetone used to transfer MTV/acetone mix into the vessel - MTV stuck to vessel walls (14%) 0.63 g/mL bulk density - white spots in MTV - Teflon will be delump in blender in next batches - Sensitivity test: Impact 350 mm(NPP3+), 228 mm Brucetion; Sliding friction 135 psi; Electrostatic discharge 8.33 Joules - No Viton in collected acetone -
[7]THAR Pump used - Teflon delumped in blender 40 sec medium speed - no white pieces in MTV - No Fluorel in collected acetone
[8]No Agitation - MTV solid soft cylinder - No white spots uniform gray
[9]45% of MTV near agitator was good crumb. The rest of the MTV was a solid piece. - Need multiple agitators - leak in collection system
[10]Fluorel/acetone (20%) pumped 7 mL/min into pressure vessel at 2000 psi and 50° C. - MTV at top 55% Fluorel and 3% Fluorel at bottom - No Fluorel in collected acetone
[11]No smell of acetone - No Viton in collected acetone -Sensitivity test: Impact >1000 mm(NPP3+), >1000 mm Brucetion; ABL friction 180 psi; Blectrostatic discharge 8.33 Joules - Analysis: Fluorel 11.9%; Mg 56.0%; Teflon 32.1%
[12]36.4% Fluorel collected in recovered acetone! In 500 mL vessel 107 mL MTV, 267 mL acetone and 37 mL agitator. This leaves 89 mL for the $CO_2$
[13]2% Fluorel collected in recovered acetone.
[14]Less than 0.1% of the Fluorel collected in recovered acetone. Part of batch stuck to vessel walls and agitators.
[15]Less than 0.1% of the Fluorel collected in recovered acetone. Batch 300 atm (4,410 psi) and 60° C.

Obviously, other modifications and variations of the present invention may be possible in light of the foregoing teachings. It is therefore to be understood that within the scope of the appended claims the invention may be practiced otherwise than as specifically described.

What is claimed is:

1. A process for producing energetic materials comprising:

A. dissolving a vinylidenefluoride-hexafluoropropylene copolymer in a ketone solvent that is acetone, methyl ethyl ketone, or mixtures thereof;

B. forming a slurry by adding a mixture of polytetrafluoroethylene particles and reactive metal particles that are magnesium particles, magnesium alloy particles, aluminum particles, aluminum alloy particles, or mixtures thereof to the solution formed in step A;

C. adding $CO_2$ to the slurry formed in step B to cause the vinylidenefluoride-hexafluoropropylene copolymer to precipitate out of the ketone solvent and coat the polytetrafluoroethylene particles and the reactive metal particles while the slurry is agitated; and D. separating the vinylidenefluoride-hexafluoropropylene copolymer-coated polytetrafluoroethylene particles and reactive metal particles from the ketone solvent and the $CO_2$.

2. The process of claim 1 wherein the ketone solvent is acetone.

3. The process of claim 1 wherein the ketone solvent is methyl ethyl ketone.

4. The process of claim 1 wherein the reactive metal particles are magnesium particles, magnesium alloy particles or mixtures thereof.

5. The process of claim 4 wherein the reactive metal particles are magnesium particles.

6. The process of claim 1 wherein the vinylidenefluoride-hexafluoropropylene copolymer is the vinylidenefluoride-hexafluoropropylene(70:30) copolymer.

7. The process of claim 1 wherein in step C the slurry is in a closed system into which the $CO_2$ is fed at a pressure of from about 1,000 to about 10,000 psi and a temperature of about 15° to about 80° C.

8. The process of claim 7 wherein the $CO_2$ in step C is at a pressure of from 1000 to 5000 psi.

9. The process of claim 8 wherein the $CO_2$ in step C is at a pressure of from 2000 to 4500 psi.

10. The process of claim 7 wherein the $CO_2$ in step C is at a temperature of from 31° to about 80° C.

11. The process of claim 10 wherein the $CO_2$ in step C is at a temperature of from 60° to 80° C.

12. The process of claim 7 wherein the $CO_2$ is fed into the system until it has dissolved in the ketone solution to form a ketone/$CO_2$ solution containing at least 60 weight percent $CO_2$ with the remainder being the ketone.

13. The process of claim 12 wherein the $CO_2$ feed is continued until the ketone/$CO_2$ solution contains at least 70 weight percent $CO_2$.

14. The process of claim 13 wherein the $CO_2$ feed is continued until the ketone/$CO_2$ solution contains at least 80 weight percent $CO_2$.

15. The process of claim 14 wherein the $CO_2$ fed is continued until the ketone/$CO_2$ solution contains at least 90 weight percent $CO_2$.

16. The process of claim 1 wherein in step D the slurry is in an open system and a flow of $CO_2$ at a pressure of from about 1,000 to about 10,000 psi and a temperature of from about 15° to about 80° C. is used to remove the ketone from the product vinylidenefluoride-hexafluoropropylene copolymer-coated polytetrafluoroethylene and reactive metal particles, after which the flow of $CO_2$ is stopped and the $CO_2$ is allowed to evaporate from the product.

17. The process of claim 16 wherein the $CO_2$ in step D is at a pressure of from 1000 to 5000 psi.

18. The process of claim 17 wherein the $CO_2$ in step D is at a pressure of from 2000 to 4500 psi.

19. The process of claim 16 wherein the $CO_2$ in step D is at a temperature of from 35° to about 80° C.

20. The process of claim 19 wherein the $CO_2$ in step D is at a temperature of from 60° to 80° C.

21. The process of claim 1 wherein the $CO_2$ and the ketone solvent removed in step D are each isolated and purified for reuse.

* * * * *